US009890603B2

(12) United States Patent
Moore et al.

(10) Patent No.: US 9,890,603 B2
(45) **Date of Patent: *Feb. 13, 2018**

(54) QUARTER TURN TUBING ANCHOR CATCHER

(71) Applicant: TAZCO HOLDINGS INC., Calgary (CA)

(72) Inventors: Edward L. Moore, Calgary (CA); Christopher S McArthur, Calgary (CA); Jasen L. Hoffman, Airdrie (CA); Kevin D. Kelm, Edmonton (CA)

(73) Assignee: Tazco Holdings Inc., Calgary, Alberta (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/705,846

(22) Filed: May 6, 2015

(65) Prior Publication Data

US 2015/0233199 A1 Aug. 20, 2015

Related U.S. Application Data

(63) Continuation-in-part of application No. 14/311,322, filed on Jun. 22, 2014, now abandoned, and a continuation-in-part of application No. 13/716,075, filed on Dec. 14, 2012, now abandoned.

(51) Int. Cl.
*E21B 23/01* (2006.01)
*E21B 33/129* (2006.01)

(52) U.S. Cl.
CPC ..... *E21B 23/01* (2013.01); *E21B 33/1292* (2013.01)

(58) Field of Classification Search
CPC ..... E21B 19/16; E21B 17/02; E21B 17/021; E21B 23/01; E21B 33/12; E21B 33/129; E21B 33/1292
See application file for complete search history.

(56) References Cited

U.S. PATENT DOCUMENTS 3,077,933 A 2/1963 Bigelow
3,314,480 A * 4/1967 Scott ..... E21B 33/1265 166/121
3,332,494 A * 7/1967 Scott ..... E21B 23/00 166/121

(Continued)

FOREIGN PATENT DOCUMENTS

CA 933089 9/1973
CA 2160647 5/2002

*Primary Examiner* — Yong-Suk (Philip) Ro

(57) ABSTRACT

A tubing anchor catcher for anchoring well equipment in a well conduit to arrest movement in both longitudinal directions and rotational directions. A mandrel connected to the equipment has one or more grooves for slideably receiving respective drive pins from a drag body on the mandrel. A slip cage on the mandrel houses a slip or slips for selectively engaging and disengaging the conduit. Manipulation of the mandrel at surface causes the drive pins to move within the one or more grooves on the mandrel and the drag body conical surface to move toward the slip cage driving the slip or slips outward to grip the conduit. Further pulling at surface maintains the set position. The anchor is unset at surface by releasing the tension, rotating the mandrel in the second direction, and pulling the mandrel to disengage the slip or slips.

26 Claims, 8 Drawing Sheets

(56) References Cited

U.S. PATENT DOCUMENTS

| | | | | |
|---|---|---|---|---|
| 3,489,211 | A * | 1/1970 | Kammerer, Jr. | E21B 4/18 166/301 |
| 3,494,418 | A * | 2/1970 | Young | E21B 23/006 166/123 |
| 3,526,277 | A * | 9/1970 | Scott | E21B 33/1265 166/121 |
| 5,146,993 | A * | 9/1992 | Gambertoglio | E21B 33/1292 166/138 |
| 5,148,866 | A | 9/1992 | Greenlee | |
| 5,311,939 | A * | 5/1994 | Pringle | E21B 33/1292 166/134 |
| 5,350,013 | A * | 9/1994 | Jani | E21B 23/01 166/217 |
| 5,771,969 | A | 6/1998 | Garay | |
| 7,255,172 | B2 | 8/2007 | Johnson | |
| 7,654,334 | B2 | 2/2010 | Manson | |
| 2006/0225877 | A1 | 10/2006 | Brookey et al. | |
| 2012/0160523 | A1 * | 6/2012 | Burgos | E21B 33/1293 166/387 |
| 2013/0213635 | A1 * | 8/2013 | Carro | E21B 33/1293 166/120 |
| 2013/0319683 | A1 * | 12/2013 | Aldridge | E21B 23/01 166/377 |

* cited by examiner

QUARTER TURN TUBING ANCHOR CATCHER

CROSS REFERENCE TO RELATED APPLICATIONS

This application claims priority from Canadian Patent Application No. 2,854,409 filed Jun. 14, 2014 entitled Quarter Turn Tubing Anchor and Catcher. This application is also a continuation-in-part of United States patent application Ser. No. 14/311,322 filed Jun. 22, 2014 and entitled Quarter Turn Tubing Anchor and Catcher, which is itself a continuation-in-part of U.S. patent application Ser. No. 13/716,075 filed on Dec. 14, 2012 and entitled Quarter Turn Tension Torque Anchor. The entire disclosures of these priority documents and all related applications or patents are incorporated herein by reference.

FIELD OF THE INVENTION

The present invention relates to a quarter turn tubing anchor catcher and its use in a system with a downhole reciprocating rod pump or progressive cavity pump, within in a well conduit.

BACKGROUND OF THE INVENTION

A tubing string is used for producing hydrocarbons and to position downhole tools proximal to one or more underground geological formations that contain petroleum fluids of interest. The tubing string may also be referred to as production tubing or a production string. The tubing string is made up of sections of individual pipe joints that are typically threaded together. The tubing string extends within a bore of the well. The well bore is typically completed with casing or liners. The completed well bore may also be referred to as a well conduit. The tubing string can carry various downhole tools into the well conduit. For example, downhole tools can be used for various purposes including anchoring the tubing string and reciprocating rod pump within the wellbore at a desired location and to limit movement of the tubing string.

Tubing anchor catchers are used to limit movement axially and radially in both directions. Prior art tubing anchor catchers comprise threads or helical bearings that require multiple full (i.e. 360 degree) rotations of the mandrel to either set or unset the tubing anchor catcher. Disadvantages of such tubing anchors catchers include the expense of manufacturing the threaded portions, the threads may be susceptible to corrosion and the threads may be difficult to, or unable to, unset if they become filled with sand or corroded. With the new technology of fracing, the industry has adopted a heavier weight casing to be able to handle the bends and 'S' curves that are drilled today. A heavier weight casing wall makes the interior diameter of the casing smaller. This change in diameter, combined with the wells drilled with deviations and horizontally, makes the setting of the older design (multiple revolutions) tubing anchor catchers difficult.

Applicant's U.S. application entitled Quarter Turn Tension Torque Anchor and assigned U.S. application Ser. No. 13/716,075 has improved on these designs by providing a means for transferring a short longitudinal movement into actuation of conical surfaces to extend the slips into gripping engagement with the well conduit. However the apparatus and method of U.S. Ser. No. 13/716,075 do not provide a means to stop downward movement of the tubing string and attached equipment downhole when tubing joints above such apparatus unexpectedly come apart.

It is therefore desirable to have a tubing anchor catcher that further improves on these prior designs. Particularly, there is a need for a tubing anchor catcher that avoids the prior art threads and helical bearing that require multiple full rotations of the tubing anchor catcher's mandrel to either set or unset the tool. The tubing anchor catcher should not need to translate rotational movement into linear movement to engage the slips with the well conduit, but rather should directly transfer a short longitudinal movement to extend the slips into gripping engagement with the well conduit. The tubing anchor catcher should requirement only a limited rotation. Also, the tubing anchor catcher should have a simple and effective means to stop the tubing string from downward movement if tubing joints above such apparatus unexpectedly come apart.

SUMMARY OF THE PRESENT INVENTION

The present invention provides a tubing anchor catcher that acts to stop movement of a tubing string within a wellbore in both directions axially and radially. The tubing anchor catcher may also catch the tubing string if a part of the tubing string above the tubing anchor catchers disconnects.

One example embodiment of the present invention provides a tubing anchor catcher tool that is positionable within a well conduit for preventing movement of a tubing string. The tool comprises: a mandrel that is connectible at either end to the tubing string, the mandrel comprising a groove; a first cone element that is slidably mountable on to the mandrel, the first cone element comprising a first conical surface; a drag body that is slidably mountable on the mandrel, the drag body comprising a drag member that is sized for frictionally engaging an inner surface of the well conduit, a pin for engaging the groove, and a second conical surface; a biasing member that is slidably mountable on the mandrel adjacent the drag body for engaging the first cone element when the biasing member is compressed; and a slip cage that is slidably mountable on the mandrel, the slip cage comprising a slip or slips that are adapted for engaging the inner surface of the well conduit when one or more of the conical surfaces are disposed underneath the slip or slips.

BRIEF DESCRIPTION OF THE DRAWING FIGURES

Embodiments of the invention will now be described, by way of example only, with reference to the accompanying drawings, wherein.

DESCRIPTION OF PREFERRED EMBODIMENTS

Figure 1:
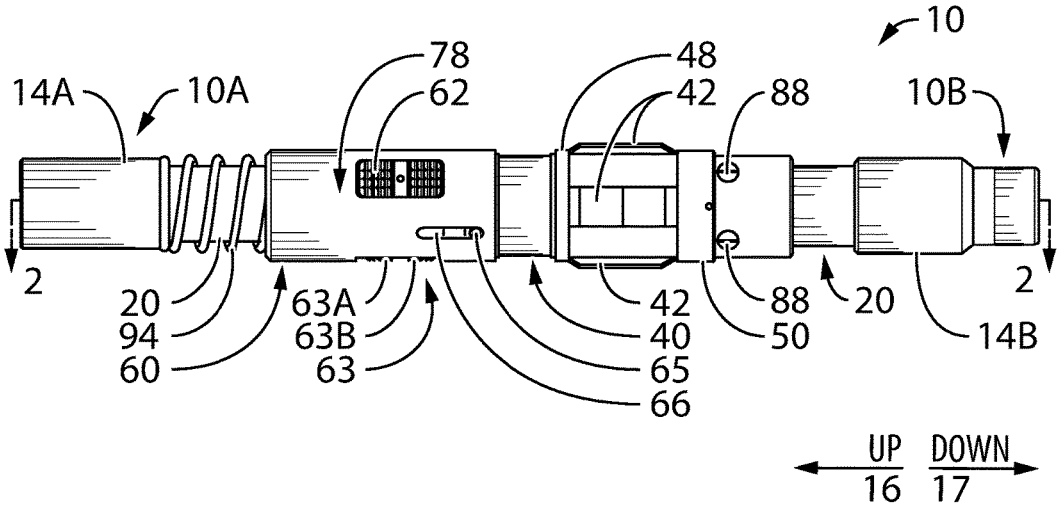
FIG. 1 is an elevation side view of a first embodiment of a tubing anchor catcher.
Figure 2:
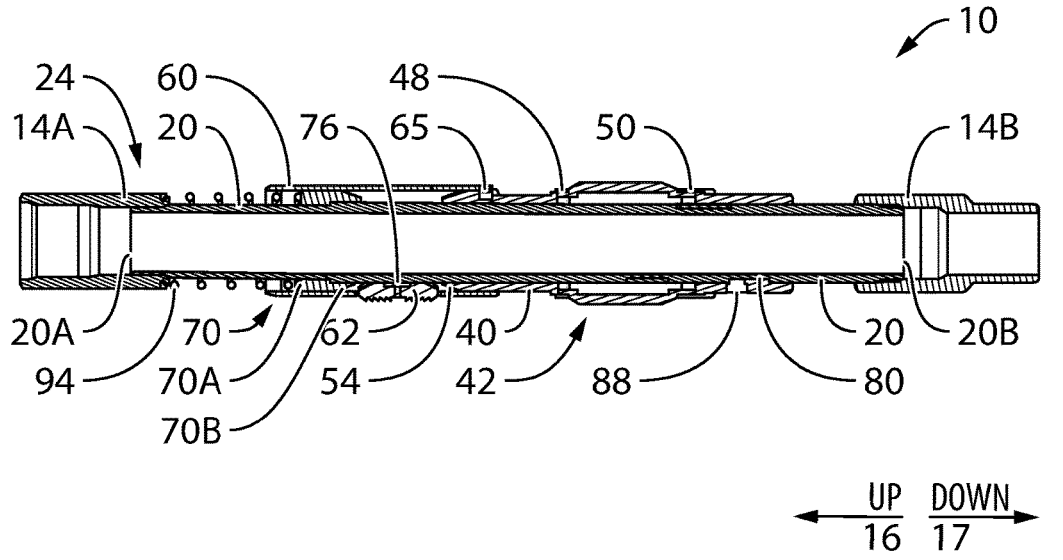
FIG. 2 is a mid-line cross-sectional view taken along line 2-2 in FIG. 1.
Figure 13:
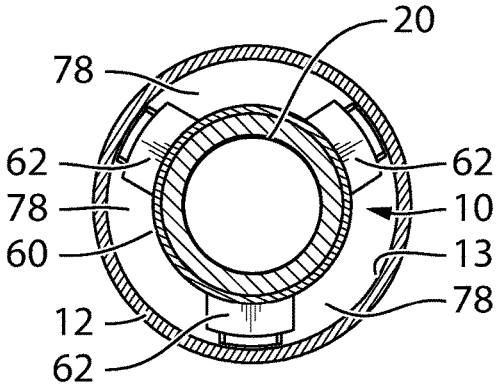
FIG. 13 is a cross-sectional view taken along line 13-13 in FIG. 12.

FIGS. 1 to 8 depict one example embodiment of a tubing anchor catcher 10. The tubing anchor catcher 10 may be inserted within a well conduit 12 (see FIGS. 13 and 14), such as a wellbore casing. FIGS. 1 and 2 depict the tubing anchor catcher 10 in an unset, or "run-in", orientation in which it can be run inside the well conduit 12 on a tubing string. Safety subs 14A, B may be attached to a mandrel 20 of the tubing anchor catcher 10, thus forming a lower pin end 10B and an upper box end 10A. In this embodiment, the tubing anchor catcher 10 may be run down the well conduit 12 while being threaded together within the tubing string in the downhole direction indicated by arrow 17. Arrow 16 indicates the opposite direction within the well conduit 12, namely the up-hole direction. It is noted, however, those terms such as "up", "down", "forward", "backward" and the like are used to identify certain features of the tubing anchor catcher 10 when placed in a well conduit. These terms are not intended to limit the tubing anchor catcher's use or orientation.

The tubing anchor catcher 10 has an upper end 10A and a lower end 10B. The tubing anchor catcher 10 may comprise of a drag body 40, a slip cage 60 and a biasing member 94, all of which are mounted about the external surface of the mandrel 20. The biasing member 94 can be for example, a coiled spring. The drag body 40 houses a drag means, in the form of one or more drag springs or drag blocks 42, for spacing the tubing anchor catcher 10 away from the inner wall 13 of the conduit 12. The drag blocks 42, for example three or four drag blocks 42, may be generally evenly spaced circumferentially about the tubing anchor catcher 10. Each drag block 42 has a drag block spring 44 to urge the outer surface 46 of the drag block against the well conduit's inner wall. Upper and lower drag retaining rings 48, 50 keep the drag blocks 42 removably mounted within the drag body 40. In addition to keeping the tubing anchor catcher 10 spaced from the well conduit 12, the contact of the drag block surface 46 the well conduit's 12 inner wall or surface 13 causes friction that urges the drag body 40 to remain stationary while the mandrel 20 moves within the rest of the tubing anchor catcher 10.

As will be discussed further, the drag body 40 is connected to the mandrel 20 by one or more drive pins 88 that extends inwardly from the drag body's 40 inner surface to engage an externally facing groove 80 that is on the outer surface of the mandrel 20. As described further below, in one example embodiment, the drive pins 88 are made from a shearable material.

The slip cage 60, which may also be referred to as a slip retainer, is also mounted on the mandrel 20 adjacent the drag body 40. In particular, the slip cage 60 is mounted on the mandrel 20 above the drag body 40 (i.e. in direction 16). The slip cage 60 may house one or more movable slips 62. For example, three slips 62 are depicted as being evenly spaced about the slip cage 60, although this is not intended to be limiting as the tubing anchor catcher 10 described herein may operate with one or more slips 62. Each slip 62 has an outer surface with teeth 63 for gripping the inner wall 13 upon contact. The teeth 63 comprise upward gripping teeth 63B and downward gripping teeth 63A. One or more fasteners in the form of a cap pin or cap screw 65 is fastened to the drag body 40 and is each located within one of a plurality of associated elongate slots 66 that are defined by the slip cage 60 and spaced circumferentially thereabout, preferably between each slip 62. The cap screw 65 is adapted to travel within associated slots 66, to permit movement of the slip cage 60 relative to the drag body 40 and to prevent the slip cage 60, and the drag body 40, from longitudinally separating.

A cone element 70 is mounted about the mandrel 20 at an upper end of the slip cage 60. The cone element 70 comprises an upper edge 70A and a lower edge 70B. The lower edge 70B forms a first conical surface whose inclined surface wedges under the slip or slips 62 when the tubing anchor catcher 10 is moved into a set position. Likewise, an upper edge of the drag body 40 forms a second conical surface 54 whose inclined surface also wedges under the slip or slips 62 when the tubing anchor catcher 10 is moved into a set position. When the tool is in the unset position, the first and second conical surfaces 70B, 54 do not actuate the slip or slips 62. A slip spring 76 urges each slip 62 radially inwardly into the slip cage 60 and away from the well conduit 12 while in the unset position (FIG. 2).

Figure 3:
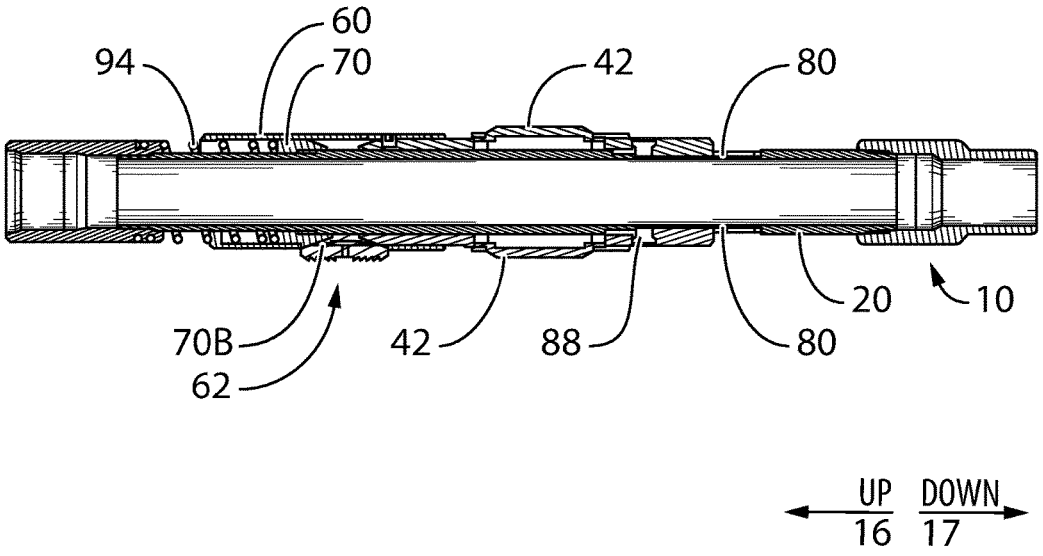
FIG. 3 is a mid-line cross-sectional view of FIG. 1 showing the tubing anchor catcher with its slips extended.

FIG. 3 depicts the tubing anchor catcher 10 in the set position with the slip or slips 62 extended outwardly from the slip cage 60 for engaging the inner surface 13 of the well conduit 12. The slip or slips 62 are extended due to the conical surfaces 70B, 54 moving underneath the slip or slips 62. The biasing member 94 is compressed due to the movement down of the mandrel, which movement forces the first and second conical surfaces 70B, 54 underneath the slip or slips 62.

Figure 4:
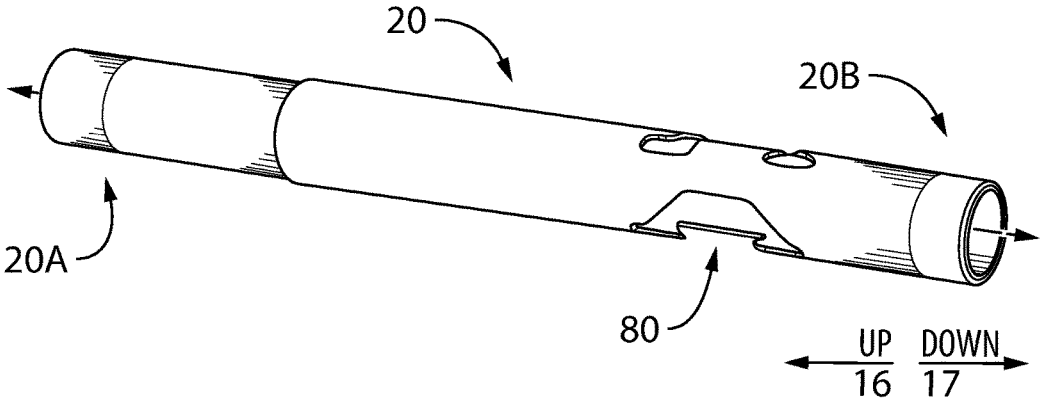
FIG. 4 is a perspective view of an example embodiment of a mandrel for use as part of the tubing anchor catcher of FIG. 1.
Figure 4:
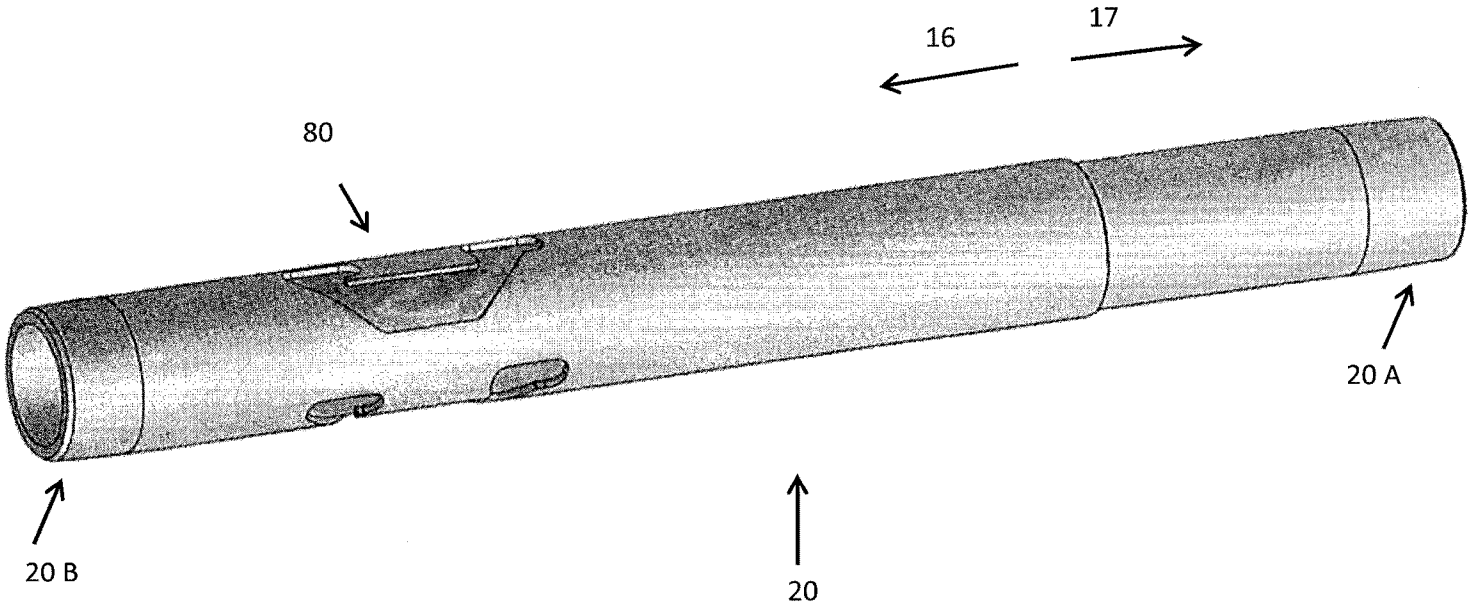
Figure 5:
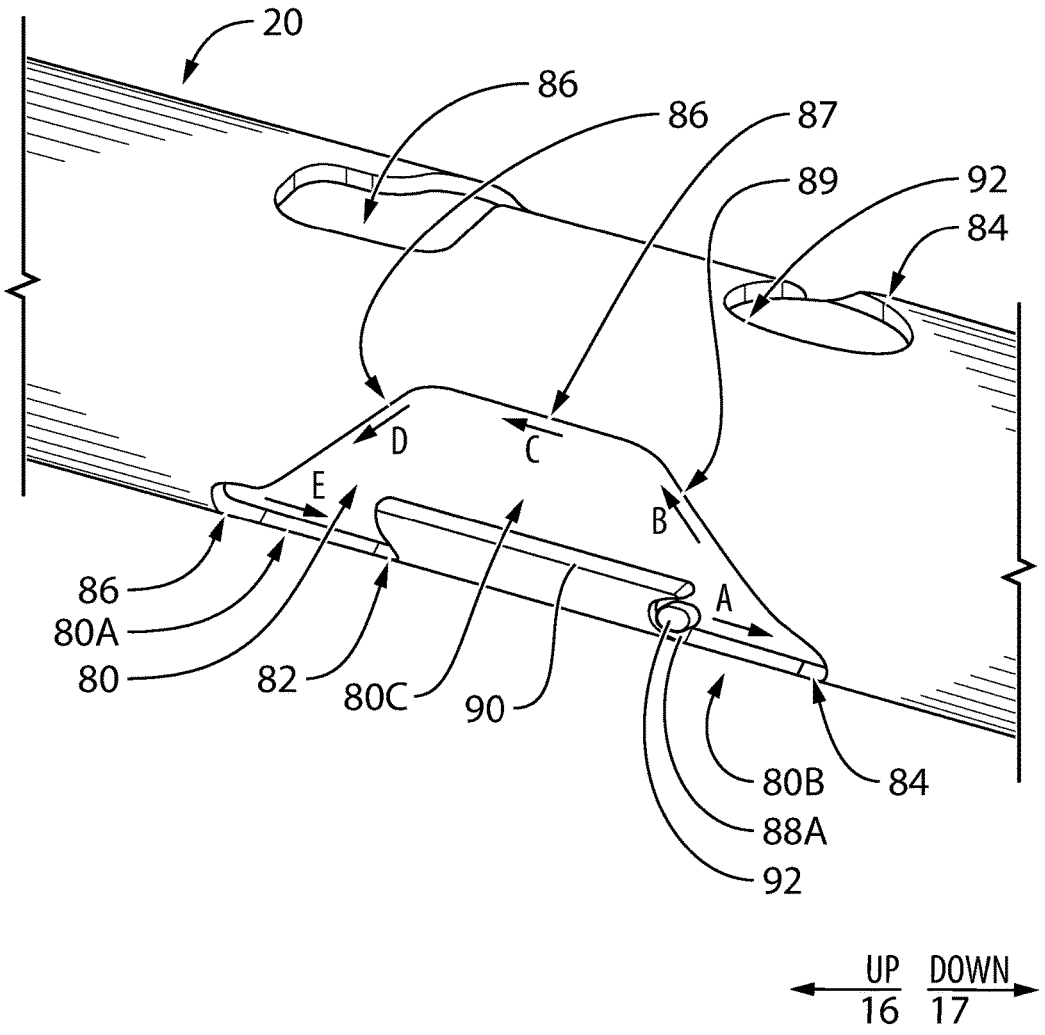
FIG. 5 is an enlarged view of an example embodiment of a groove that forms part of the mandrel of FIG. 4, showing a pin from the tubing anchor catcher engaged in the groove, in a run-in position.
Figure 6:
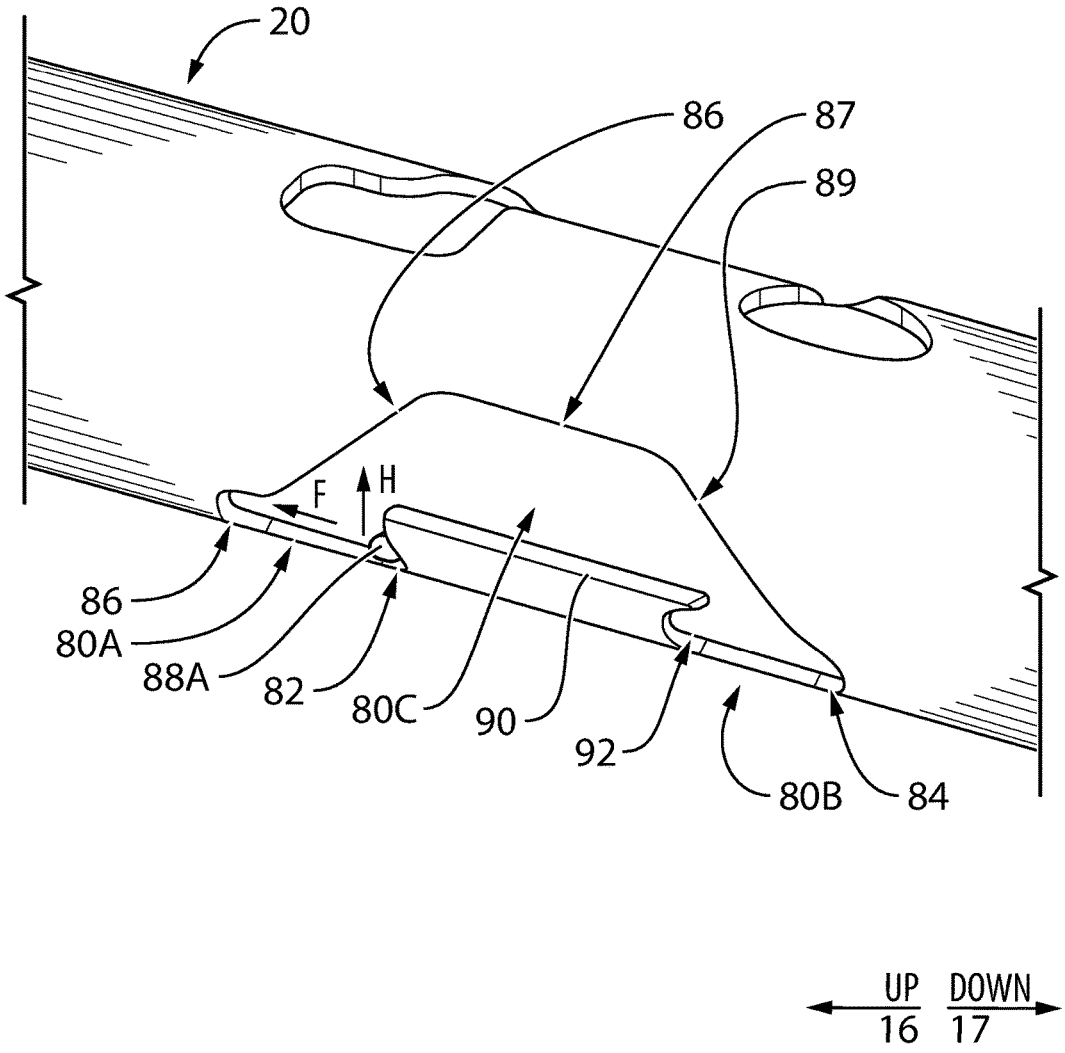
FIG. 6 is the view of FIG. 5 showing the pin in a set position.
Figure 7:
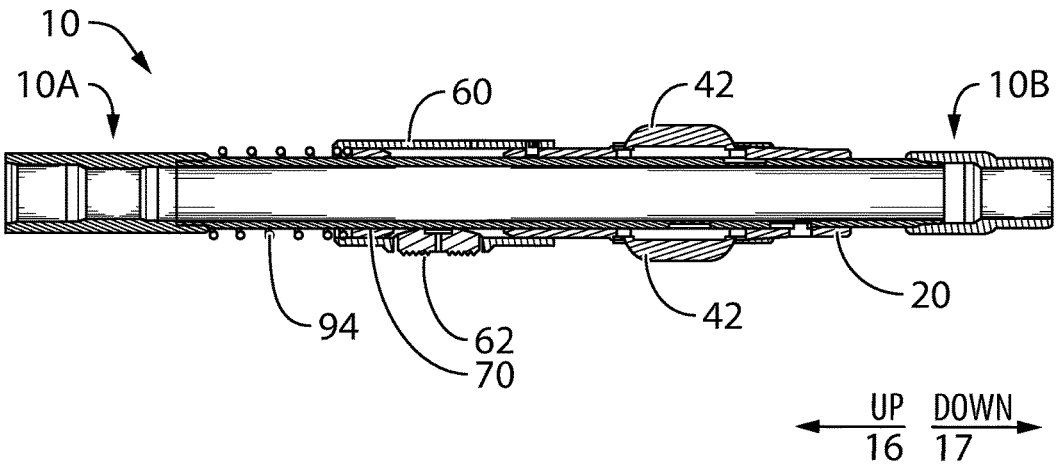
FIG. 7 is a mid-line cross-sectional view of an example embodiment of a tubing anchor catcher, in the run-in position.
Figure 8:
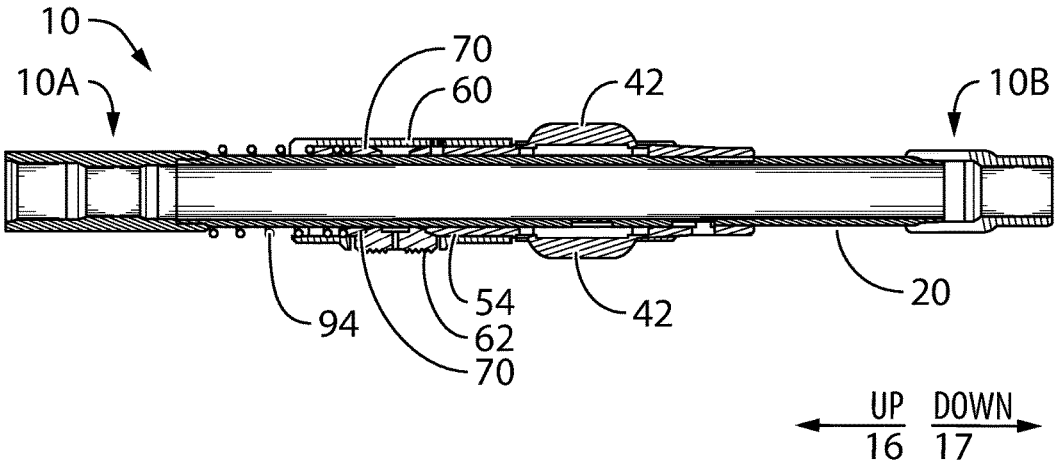
FIG. 8 is a mid-line cross-sectional view of the tubing anchor catcher of FIG. 7, in the set position.
Figure 9:
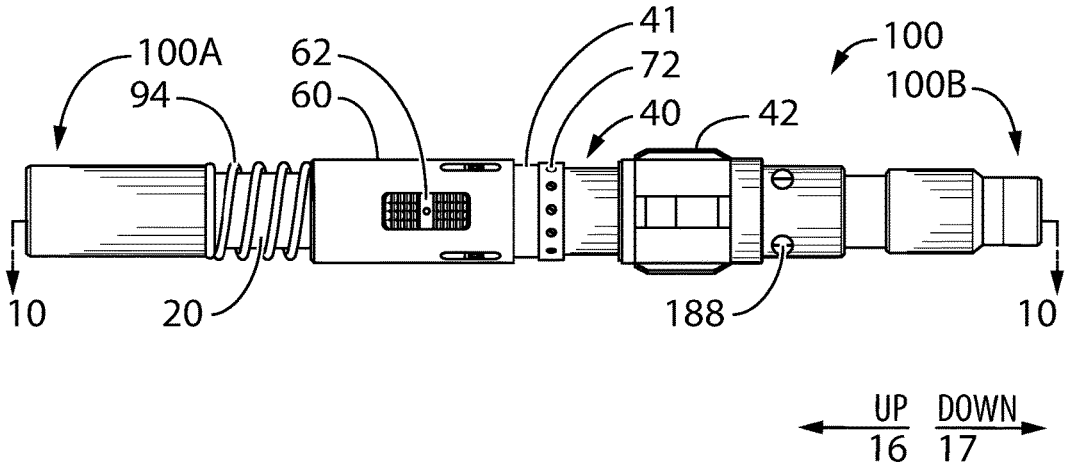
FIG. 9 is a side elevation view of a second embodiment of a tubing anchor catcher.
Figure 10:
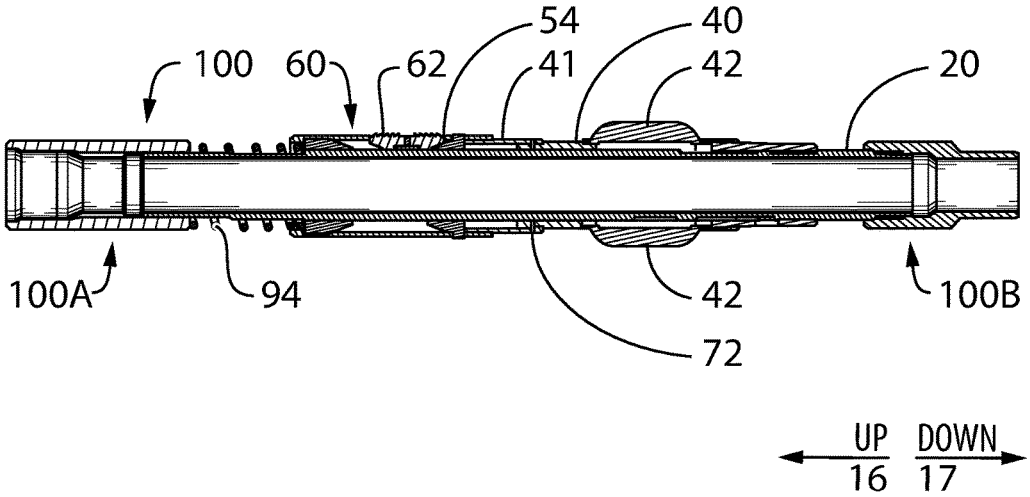
FIG. 10 is a mid-line, sectional view of the tubing anchor catcher of FIG. 9; and, FIG. 11 is an exploded isometric view of parts of the tubing anchor catcher of FIG. 9.
Figure 11:
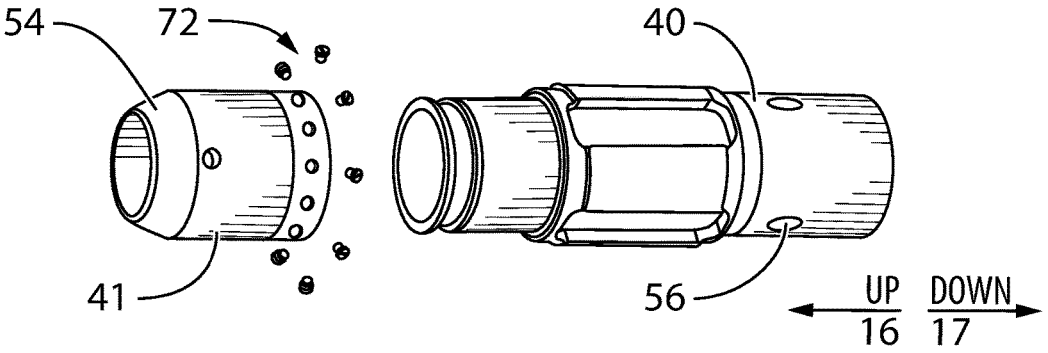
Figure 12:
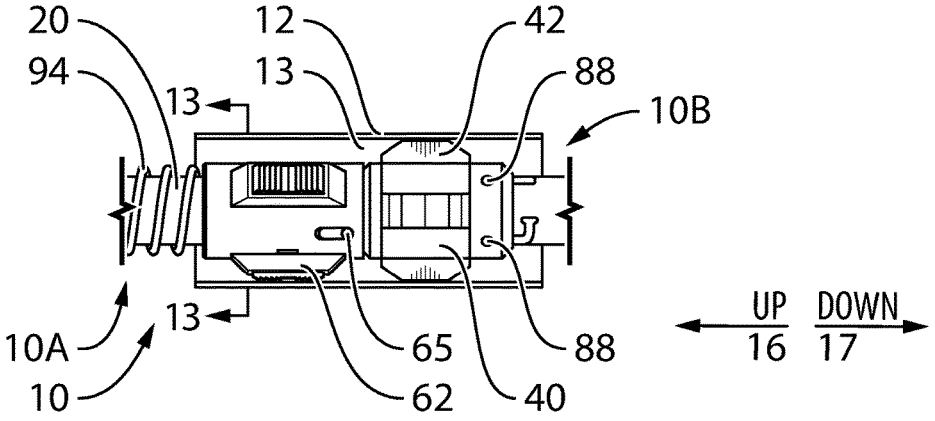
FIG. 12 is a side elevation view of an example of the first embodiment of a tubing anchor catcher positioned within a well bore.

FIG. 4 depicts the mandrel 20 as including an upper end 20A and a lower end 20B. As described above, the upper and lower ends 20A, B may each comprise threaded connections for connecting the mandrel 20 to the tubing string, optionally via safety subs 14A and 14B, thus providing an the upper end 10A comprises a box threading and the lower end 10B comprises a pin threading. At least one groove 80 is formed on the mandrel's outer surface 26, as best seen in FIGS. 4 to 6. The groove 80 is dimensioned (width, depth) to slidingly accommodate a protruding portion of the drive pin 88 that extends therein threaded through a hole 56 in the drag body 40. The lower retaining ring 50 retains the drag blocks 42 within the drag body 40. The tubing anchor catcher 10 may comprise one or more sets of grooves 80 and drive pins 88. For example, the tubing anchor catcher 10 may have three or four sets of grooves 80 and three or four sets of associated drive pins 88 that are generally evenly radially spaced about the mandrel 20.

As depicted in FIGS. 5 and 6, the groove 80 may comprise a C-shape with shoulders 82 and 86 defining a first arm 80A of the groove 80 and shoulders 84 and 92 defining a second arm 80B of the groove 80. The two arms 80A, B of the groove 80 are connected by central portion 80C that is defined by walls 86, 87, 89 and 90. Wall 90 separates the first and second arms 80A, B.

The operation of the tubing anchor catcher may now be described with reference to all figures, including figures 5 and 6 showing the drive pin 88 positions of the groove 80. As seen in FIGS. 5 and 6, which is an enlarged view of groove 80, a portion 88*a* of the drive pin 88 protudes into the groove 80 and is seated against the shoulder 92 in the run-in (i.e. un-set) position with the slip or slips 62 retracted within the sip cage 60. To move the drive pin 88 to the set position at shoulder 82, the tubing string can be manipulated at surface so as to move axially, i.e. by pulling or pushing, and rotationally, i.e. by turning, so as to similarly manipulate the mandrel 20. The manipulation at surface may articulate the tubing anchor catcher 10 between the run-in position and a set position. Due to the drag blocks 42 frictionally engaging the inner surface 13 of the well conduit 12, the drag body 40 and the slip cage 60 remain relatively fixed as the mandrel 20 and the rest of the tubing string, are manipulated from surface. As manderel 20 is pulled, in direction 16, the drive pin 88 becomes repositioned in mandrel 20 in direction A towards shoulder 84. Thereafter, the mandrel 20 can be lowered, and turned, for example, a quarter turn to the right, or clockwise as viewed from above (i.e. about 90 degrees). As known in the art, anchor catchers are commonly right hand set/right hand release for reciprocating rod pumps. The turning is about the longitudinal axis of the tubing string and, therefore, the tubing anchor catcher 10. This manipulation causes the drive pin 88 to be relocated from shoulder 84, generally along walls 89, 87 and 86 to rest in shoulder 86 of the first arm 80A. When the drive pin 88 is in shoulder 86, the tubing anchor catcher 10 is in a pre-set position. Pulling the tubing string and, therefore, the mandrel 20 upwards, in direction 16 will cause the drive pin 88 to be relocated into shoulder 82. When the drive pin 88 is in shoulder 82, conical surfaces 54 and 70B have moved under the slip or slips 62 and the tubing anchor catcher 10 is set with the slip or slips 62 extending outwards from the slip cage 60 to engage the inner surface 13 of the well conduit 12. At this point, tension can be applied to the tubing string and the tubing string can be landed in a tubing hanger.

Groove 80 is in the shape of a "C", although this is not intended to be a literal graphical description of shapes that will work, as other shapes will work other than exact C-shapes as may mirror images of the groove 80.

To release the slip or slips 62, the tubing string and, therefore, the mandrel 20 can be manipulated at surface. For example, the mandrel 20 can be moved relative to the rest of the tubing anchor catcher 10, so that the drive pin 88 is relocated out of shoulder 82. As shown in FIG. 6, the mandrel 20 can be pushed down so that the drive pin 88 is relocated along line F toward shoulder 86. With a quarter turn to the right the drive pin 88 will be repositioned along line H and then a straight pulling up of the tubing string and mandrel 20 will cause the mandrel 20 to move so that the drive pin 88 ends up in shoulder 84. When the drive pin 88 has been relocated out of the first arm 80A of the groove 80, the conical surface 54 moves out from under the slip or slips 62 and the spring 76 will cause the slip or slips 62 to retract back into the slip cage 60.

When the tubing anchor catcher 10 is in the set position and in the event of a break in the tubing string, etc, which may cause the tubing string to fall down into the well (i.e., in direction 17), the tension in the tubing string is lost. This causes the weight of the tubing string to bear on the upper safety sub 14A, which will bear on the biasing member 94. The biasing member 94 will compress, from the weight of the tubing string above, and act against the upper edge 70A of the cone 70. This action causes the downwardly gripping upper teeth 63A to more directly engage and bite into the inner surface 13 of the well conduit 12. For example, the greater the amount of tubing string weight that compresses the biasing member 94, the harder, or more directly, the upper teeth 63A will engage the inner surface 13 of the well conduit 12. When the upper teeth 63A are more directly engaged into the inner surface 13 of the well conduit 12, the upper teeth 63A can hold the weight of the tubing string above the tubing anchor catcher 10, for example, until such time that the tubing string can be recovered from the well. The drag blocks 42 are still in frictional contact with the inner surface 13 of the well conduit 12 and the lower conical surface 54 is still wedged under the slip or slips 62.

An alternate means of un-setting the tubing anchor catcher is now described. If it is not possible to relocated drive pin 88 in a location in the groove 80 so as to unset the slip or slips 62, for example due to packing of sand or other materials into the groove 80, the slip or slips 62 may be unset by applying a sufficient upward tension on the tubing string and the mandrel 20. In one embodiment, the upward tension is of a sufficient amplitude to shear the drive pins 88, which form the primary connection between the drag body 40 and the mandrel 20. Then the mandrel 20 may then move upward (i.e. in the direction of arrow 16), relative to the drag body 40, which causes upper cone 70 to move up and out from under the slip or slips 62, which then allows slip or slips 62 to move inwardly as they move away from the second conical surface 54 of the drag body 40. This allows the slip or slips 62 to retract from contacting the inner surface of the well conduit. When the slip or slips 62 are retracted, the tubing anchor catcher 10 may be pulled out of the well conduit 12. At this time the cap 65 may engage the lower shoulder 68B of the slot 66 so that, even though the slip cage 60 is furthest away from the drag body 40, the slip cage 60 and the drag body 40 do not separate. Alternatively, or additionally, the lower edge of the drag body 40 may engage the lower safety sub 14*b* as the tubing string is pulled upwards towards the surface (i.e. in direction 16).

FIGS. 9 to 12 depict an alternative or second embodiment of a tubing anchor catcher 100 with an upper end 100A and a lower end 100*B*. The tubing anchor catcher 100 may comprise many of the same features as tubing anchor catcher 10. For example, one difference between the two tubing anchor catchers 10, 100 is that the drive pin 88 of the tubing anchor catcher 10 may be sheared as a secondary release mechanism, as described above. In contrast, the tubing anchor catcher 100 may comprise a drive pin or drive pins 188 that are not designed to shear as a secondary release mechanism. The lower cone 41 is formed as a separate piece to the drag body 40. The tubing anchor catcher 100 may comprise one or more shear pins 72 that connect the lower end of the lower cone 41 to drag body 40. The shear pins 72 are made of a material that will shear in response to a lower shearing force than the shear force required to shear the pin 188. In this embodiment, the second conical surface 54 is formed on an upper end of the lower cone 41 (see FIG. 12). Lower cone 41 slidably mounts about the external surface of the mandrel 20 so that conical surface 54 in combination with conical surface 70B on cone 70 compress together along mandrel 20 to force the slip or slips 62 into the set position, as described above. The shear pins 72 provide a secondary release of slip or slips 62 by the application of a sufficient pulling force to the tubing string so as to shear the shear pins 72. When the shear pins 72 are sheared, the lower cone 41 is released from connection with the stationary drag body 40 and can move downwardly away from its position under the slip or slips 62. The slip or slips 62 can then retract away from the inner surface 13 of the well conduit 12.

The tubing anchor catchers 10, 100 are thus designed to anchor the tubing string from movement longitudinally along the well (in both directions, up and down the well) and from rotating. The anchoring is achieved by simple setting and release procedures that require relatively little movement of the tubing string. In this instance, setting is achieved by a small pull and right hand rotation of the mandrel 20 (via the tubing string) that is adequate for the drive pins 88, 188 to travel the short distances within the groove 80. Further, both tubing anchor catchers 10, 100 can prevent a broken tubing string from falling into the well bore by the compression of the biasing member 94 causing the downward gripping teeth 63A to grip the inner surface 13 of the well conduit 12, as described above.

The slip or slips 62 and the diameter of the anchor cathcer 10, 100 may be configured to provide one or more by-pass spaces 78 between the tubing anchor catchers 10, 100 and the inner surface 13 of the well conduit 12, which may create high flow areas for fluids (e.g. gas) and solids (e.g. sand) to pass by the tubing anchor catchers 10, 100.

This optional embodiment of the tubing anchor catchers 10, 100 configured with by-pass spaces 78 may permit lines, tubes and cables such as capillary cable to be carried downhole via the large by-pass spaces 78. In particular, the fact that the tubing anchor catchers 10, 100 is set and unset by longitudinal motion and a quarter turn, permits its use with the capillary cable since the tubing anchor catchers 10, 100 may avoid wrapping of the cable around the tubing anchor catchers 10, 100. In contrast, prior art anchors require multiple full (360 degree) rotations—between two to nine full rotations for setting and unsetting—and cause an undesirable wrapping of the cable around the tubing anchor catcher as it is set, which can damage the cable. Alternately, the cables must be pre-wrapped when installed with these prior art tubing anchors catchers, so that they unwrap as the tubing anchor catcher is rotated during setting, which is tedious and undesirable. Also, if cable is required to be pre-wrapped then on setting the tool, the unwrapped extra cable becomes available to jam between the tool and the well conduit and it may be damaged, break or otherwise interfere with reliable wellbore operations.

Optionally, the drag blocks 42 may be hardened, in comparison to prior art drag springs, for a longer operational life. The slip or slips 62 may optionally be made with carbide inserts for teeth for superior durability and grip on the well conduit wall 13, and Inconel™ type springs 76 are employed for improved resistance to $H_2S$ and $CO_2$. Further, the surface of the mandrel 20 may optionally be coated with Teflon® for improved resistance to $H_2S$ and $CO_2$, and to help maintain mandrel strength.

While the above disclosure describes certain examples of the present invention, various modifications to the described examples will also be apparent to those skilled in the art. The scope of the claims should not be limited by the examples provided above; rather, the scope of the claims should be given the broadest interpretation that is consistent with the disclosure as a whole.

What is claimed is:

1. A tubing anchor catcher tool that is positionable within a well conduit for preventing movement of a tubing string, the tool comprising:

a. a mandrel that is connectible at a first end and a second end within the tubing string, the mandrel comprising at least one externally facing groove;

b. a slip cage that is slidably mountable about the mandrel, the slip cage comprising a slip or slips that are adapted for engaging the inner surface of the well conduit;

c. a first upper cone element that is slidably mountable about the mandrel, adjacent the slip cage towards a first end of the tool, the first cone element comprising a first conical surface;

d. a drag body that is slidably mountable about the mandrel, adjacent the slip cage towards a second end of the tool, the drag body comprising at least one drag member for frictionally engaging an inner surface of the well conduit, at least one drive pin for engaging the externally facing groove, and a second conical surface; and e. a compressible biasing member that is slidably mountable about the mandrel adjacent the first cone element for engaging the first cone element in a compressed state;

wherein the tool is articulatable between a run-in position, in which the slip or slips are retracted into the slip cage and a set position, in which the first and second conical surfaces are moved underneath the slip or slips for extending the slip or slips outward from the slip cage and wherein the at least one drive pin controls movement of the mandrel between the run-in and set positions.

2. The tool of claim 1, wherein the at least one externally facing groove comprises a C-shape with a first arm and a second arm that are connected by a central portion.

3. The tool of claim 1, wherein in the run-in position, the at least one drive pin is positioned within a shoulder of the second arm of the at least one externally facing groove.

4. The tool of claim 2, wherein in the set position, the at least one drive pin is positioned within a first shoulder of the first arm of the at least one externally facing groove and the drag body is closer to the biasing member than in the run-in position.

5. The tool of claim 3, wherein the tool is moveable to a pre-set position, wherein the at least one drive pin is positioned within a second shoulder of the first arm of the at least one externally facing groove, the second shoulder of the first arm is opposite to the first shoulder of the first arm.

6. The tool of claim 4, wherein the at least one drive pin is positionable from the run-in position to the pre-set position by means of a by longitudinal movement of the mandrel in a first direction relative to the drag body, then movement in an opposite second direction together with a quarter turn relative to the drag body; and wherein the at least one drive pin is positionable from the pre-set position to the set position by by movement of the mandrel in the first direction.

7. The tool of claim 1, wherein in the set position, the first cone element is movable under the slip or slips due to the biasing member being compressed.

8. The tool of claim 1, wherein the at least one drive pin is shearable for providing a secondary release mechanism.

9. The tool of claim 1, further comprising a second cone element that is mountable about the mandrel between the drag body and the slip cage, wherein the second cone element defines the second conical surface.

10. The tool of claim 8, wherein the second cone element is connectible to the drag body by one or more shear pins, wherein the one or more shear pins are shearable at a lower shear force than the at least one drive pin and the one or more shear pins provide a secondary release mechanism.

11. The tool of claim 1, wherein the slip or slips each comprise upward gripping teeth and downward gripping teeth.

12. The tool of claim 1, wherein the drag body further comprises one or more cap screws that extend outwardly from the drag body, each through an associated slot that is defined by the slip cage, wherein the one or more cap screws and the associated slots prevent the drag body and slip cage from longitudinally separating.

13. The tool of claim 1, wherein the slip or slips comprise three or four slips.

14. The tool of claim 12, wherein in the set position, the three or four slips define by-pass spaces therebetween.

15. The tool of claim 12, wherein each of the one or more cap and the associated slots are positioned between the three or four slips.

16. The tool of claim 1, wherein the mandrel comprises three or four externally facing grooves that are associated with three or four drive pins of the drag body.

17. The tool of claim 1, wherein the externally facing grooves and the drive pins are generally evenly radially spaced about the tool.

18. A method for anchoring well equipment or tubing in a well conduit for maintaining tension, comprising:

i. providing a tubing anchor catcher comprising:

a. a mandrel that is connectible at a first end and a second end within the tubing string, the mandrel comprising at least one externally facing groove;

b. a slip cage that is slidably mountable about the mandrel, the slip cage comprising a slip or slips that are adapted for engaging the inner surface of the well conduit;

c. a first upper cone element that is slidably mountable about the mandrel, adjacent the slip cage, towards a first end of the tool, the first cone element comprising a first conical surface;

d. a drag body that is slidably mountable about the mandrel, adjacent the slip cage towards a second end of the tool, the drag body comprising at least one drag member for frictionally engaging an inner surface of the well conduit, at least one drive pin for engaging the at least one externally facing groove, and a second conical surface; and e. a compressible biasing member that is slidably mountable about the mandrel adjacent the first cone element for engaging the first cone element in a compressed state;

ii. articulating the tubing anchor catcher between a run-in position, in which the slip or slips are retracted into the slip cage; and a set position, in which the first and second conical surfaces are moved underneath the slip or slips for extending the slip or slips outward from the slip cage and iii. using a position of the at least one drive pin in the at least one groove to control movement of the mandrel between the run-in and set positions.

19. The method of claim 18, further comprising the steps of:

i. longitudinally moving the mandrel in a first direction relative to the drag body, then movement in an opposite second direction, together with a quarter turn relative to the drag body to position the at least one drive pin in the at least one groove, from the run-in position to a pre-set position; and ii. moving the mandrel in the first direction to position the at least one drive pin in the at least one groove, from the pre-set position to the set position.

20. The method of claim 19, wherein the at least one externally facing groove comprises a C-shape with a first arm and a second arm that are connected by a central portion.

21. The method of claim 20, wherein in the run-in position, the at least one drive pin is positioned within a shoulder of the second arm of the at least one externally facing groove.

22. The method of claim 21, wherein in the set position, the at least one drive pin is positioned within a first shoulder of the first arm of the at least one externally facing groove and the drag body is closer to the biasing member than in the run-in position.

23. The method of claim 22, further comprising moving the tubing anchor catcher to the pre-set position, wherein the at least one drive pin is positioned within a second shoulder of the first arm, the second shoulder of the first arm being opposite to the first shoulder of the first arm.

24. The method of claim 18, further comprising shearing the at least one drive pin for providing a secondary release mechanism.

25. The method of claim 18, wherein the tubing anchor catcher further comprises a second cone element that is mountable about the mandrel between the drag body and the slip cage, wherein the second cone element defines the second conical surface.

26. The method of claim 25, wherein the second cone element is connectible to the drag body by one or more shear pins, wherein the one or more shear pins are shearable at a lower shear force than the at least one drive pin and the one or more shear pins provide a secondary release mechanism.

* * * * *